United States Patent [19]

Reynes

[11] Patent Number: 4,458,597

[45] Date of Patent: Jul. 10, 1984

[54] CARTRIDGE WITH FIRING ACTUATION OF THE PAYLOAD

[75] Inventor: Jean-Pierre Reynes, Toulouse, France

[73] Assignee: Etienne Lacroix Tous Artifices SA, Muret, France

[21] Appl. No.: 354,490

[22] Filed: Mar. 3, 1982

[30] Foreign Application Priority Data

Mar. 9, 1981 [FR] France ..... 81 04613

[51] Int. Cl.[3] ..... F42B 4/26

[52] U.S. Cl. ..... 102/439; 102/223; 102/251; 102/342; 102/505

[58] Field of Search ..... 102/202.1, 202.13, 222, 102/227, 226, 229, 337, 340, 342, 351, 254, 247, 248, 255, 256, 251, 357, 387, 364, 370, 439, 505, 394, 430, 258, 259, 277, 334, 272, 499, 500

[56] References Cited

U.S. PATENT DOCUMENTS

| | | | |
|---|---|---|---|
| 1,363,578 | 12/1920 | Edwards | 102/387 |
| 2,118,062 | 5/1938 | Woodberry | 102/251 |
| 2,971,463 | 2/1961 | Burrell | 102/277 |
| 3,736,876 | 6/1973 | Little et al. | 102/439 |
| 3,777,666 | 12/1973 | Morel | 102/233 |

*Primary Examiner*—Harold J. Tudor
*Assistant Examiner*—Tyrone Davis
*Attorney, Agent, or Firm*—Alan H. MacPherson; Thomas S. MacDonald

[57] ABSTRACT

A cartridge with firing actuation of the payload comprises a case solid with a case bottom which houses a threaded member constituting an ejection nozzle, and in front of the latter a missile provided with a delay ignition chain interrupted at the level of a transversally movable slide which comes into fire transmission position only after a predetermined delay. The cartridge has in addition a striker device actuated on impact so as to ignite the delay firing chain on impact, and a stabilizer device ensuring an axial deceleration permitting the satisfactory operation of the striker on impact.

16 Claims, 7 Drawing Figures

CARTRIDGE WITH FIRING ACTUATION OF THE PAYLOAD

BACKGROUND OF THE INVENTION (1) Field of the Invention

The present invention relates to a cartridge with firing actuation of its payload, and more particularly to a cartridge of the type intended to be released from an aircraft and fitted with a percussion system and a firing delay, so as to explode on the rebound at a constant altitude independent of that of release.

(2) Description of the Prior Art

To cover a relatively substantial ground area by means of missiles released from aircraft such as aeroplanes or helicopters, use is usually made of cartridges or missiles exploding at a certain altitude above ground. The explosion may be obtained by fitting the missile with a proximity detector wich controls its firing when it reaches a certain distance from the ground. However this does not provide fully satisfactory results as proximity detectors are relatively complex, and pose reliability problems.

Other methods have been proposed to ensure the explosion of the missiles at a given distance from the ground, consisting of fitting the missile with a delay firing chain, fired when the missile is ejected from its case. However with these previously proposed methods the flight characteristics of the aircraft from which the missile is released must then be determined depending upon the timing of the firing delay, so as to ensure the explosion of the missile when the latter is at the required distance from the ground. However, it will be easily understood that it is very difficult under the usual conditions of missile release to control with sufficient accuracy the flight characteristics of the aircraft and to guarantee the explosion of the missile at the desired height above ground.

SUMMARY OF THE INVENTION

According to the invention there is provided in a cartridge with firing actuation of its payload, of the type comprising a case, case bottom rigid with the case, nozzle means housed in the case bottom and acting as an impeller, and a missile in front of the impeller, said missile including a delay firing chain and the payload, the improvement comprising sliding striker means actuated on impact in order to ignite the delay firing chain situated between the striker means and the payload, and a stabiliser device permitting the satisfactory operation of the striker on impact.

Thus in a cartridge according to the invention, the firing of the delay firing chain is effected on impact, which constitutes a reference independent of the conditions of the release, and especially of its altitude.

In a preferred embodiment of the present invention, the cartridge comprises a firing device actuated on impact so as to fire a delay firing chain, situated between the firing device and the payload, and a stabiliser device operating by axial deceleration, permitting the satisfactory operation of the firing device on impact.

Preferably the stabiliser device is formed of three suspending slings connecting a cup to the rear of the missile.

Preferably the firing device is held away from the delay firing chain before the impact by means of a spring inserted between the firing device and the delay firing chain. Moreover, in order that the firing device should not be able in any event to strike the delay firing chain before the missile comes out of its case, a translatory movement of the firing device is restricted before the discharge of the missile from the case by means of a member moved at the time of the discharge from the case, so as to free the firing device.

BRIEF DESCRIPTION OF THE DRAWINGS

An embodiment of the invention will now be described, by way of example only with reference to the accompanying diagrammatic drawings, in which.

DESCRIPTION OF THE PREFERRED EMBODIMENT

Figure 1:
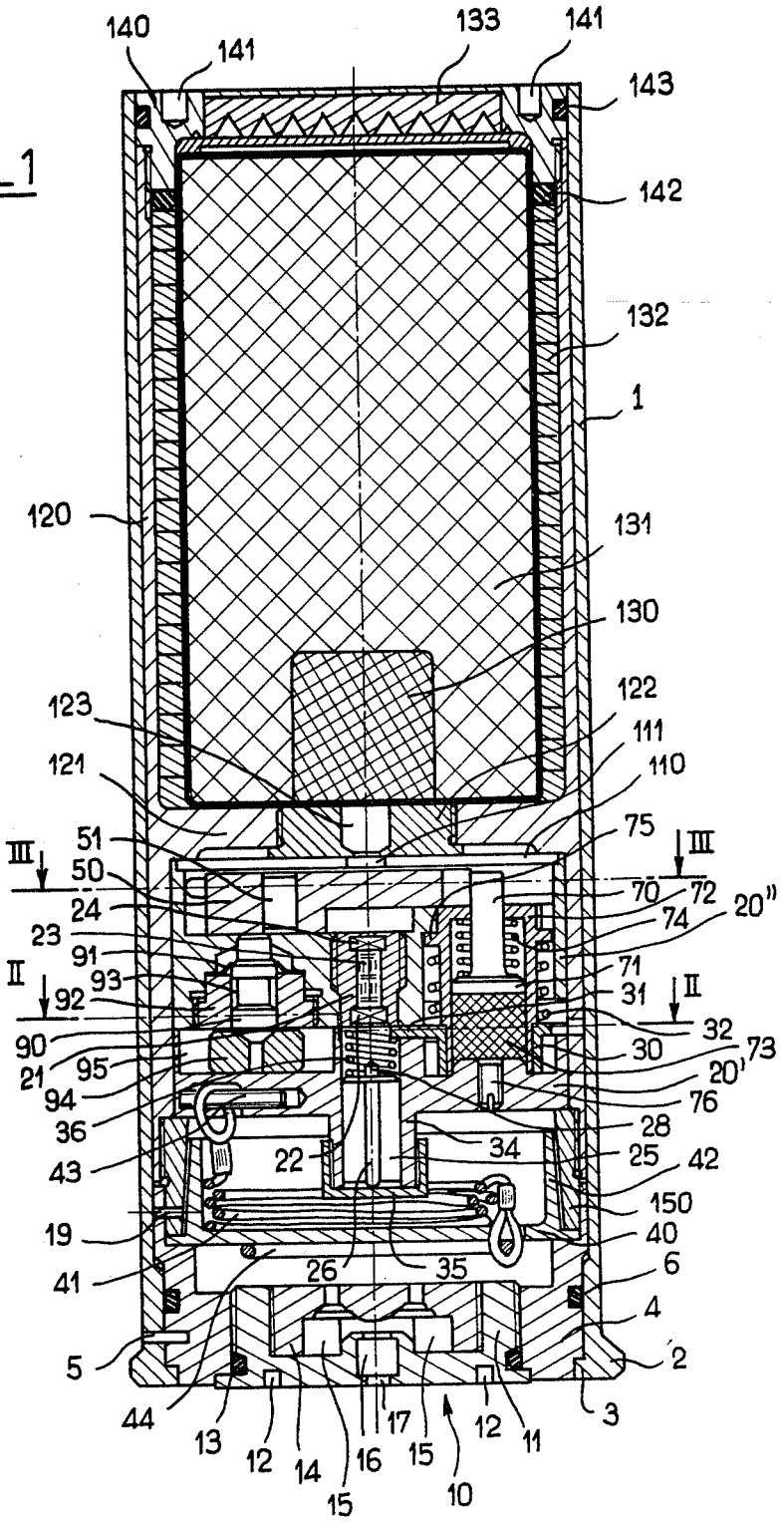
FIG. 1 is a longitudinal section passing through two discontinuous planes, denoted as I—I in FIG. 2, of a cartridge according to the present invention, a detonator-carrier slide being represented according to the section line denoted by A—A on FIG. 3.

A cartridge in accordance with the present invention as shown in FIG. 1 comprises a case 1 rigid with an impeller generally denoted by 10, and a missile, the latter being composed of a stabiliser and an explosive assembly.

The case 1 is of generally cylindrical shape provided on the external periphery of one of its ends, constituting the rear portion of the cartridge, with an annular boss 2 or case base, and on the internal periphery of this same end, with an annular projection 3 constituting an abutment for a case bottom 4, introduced into the case from the opposite end and with an outer diameter corresponding to the inner diameter of case 1. The case bottom 4 is immobilised relative to case 1 by means of three radial stop studs or pins 5. An O-ring 6 housed in an annular groove provided on the periphery of the case bottom 4 ensures seal-tightness between the case bottom 4 and the actual case 1.

The impeller 10 rigid with case 1 is formed of a threaded member 11 provided with an external thread engaging in a corresponding thread provided on the periphery of a central orifice of the case bottom 4. The head of the threaded member 11 has a diameter greater than the principal part of the threaded member 11 with the thread, so as to form a bearing abutting against the case bottom 4; axial blind holes 12 advantageously provided in the head of the threaded member 11 permit obtaining the right clamping torque using a suitable standard tool.

An O-ring 13 provided in a peripheral annular groove of the threaded member 11 ensures seal-tightness between the threaded member 11 and the case bottom 4.

A member 14 fitted with four nozzles is immobilised by threading in an axial orifice of the threaded member 11, the nozzles of the member 14 being directed towards the inside of the cartridge. This same member 14 is fitted with a chamber containing fragments of propelling powder 15 disposed facing the four nozzles, and this chamber communicates moreover with an electric primer 16 disposed in an axial bore of the threaded member 11. An outermost contact 17 of the electric primer is accessible from the back of the cartridge, firing of the primer 16 being simply achieved by the application of a direct current of 24 volts between the case 1 and the contact 17 of the primer. The operation of the primer 16 ensures the ignition of the fragments of propelling powder 15 and the combustion gases are released through the four nozzles of member 14.

Figure 2:
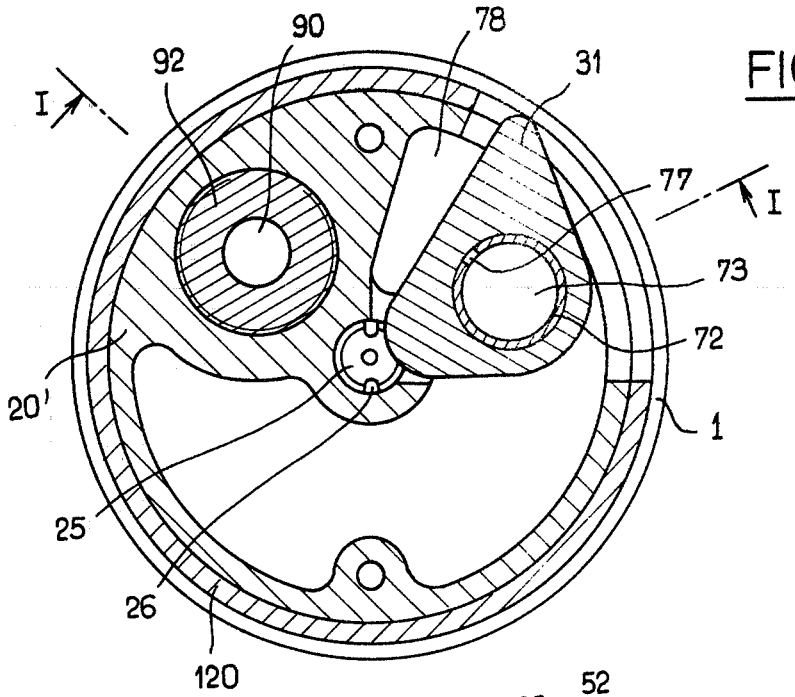
FIG. 2 is a view of the cartridge along the section line denoted by II—II in FIG. 1, passing through two discontinuous planes.
Figure 3:
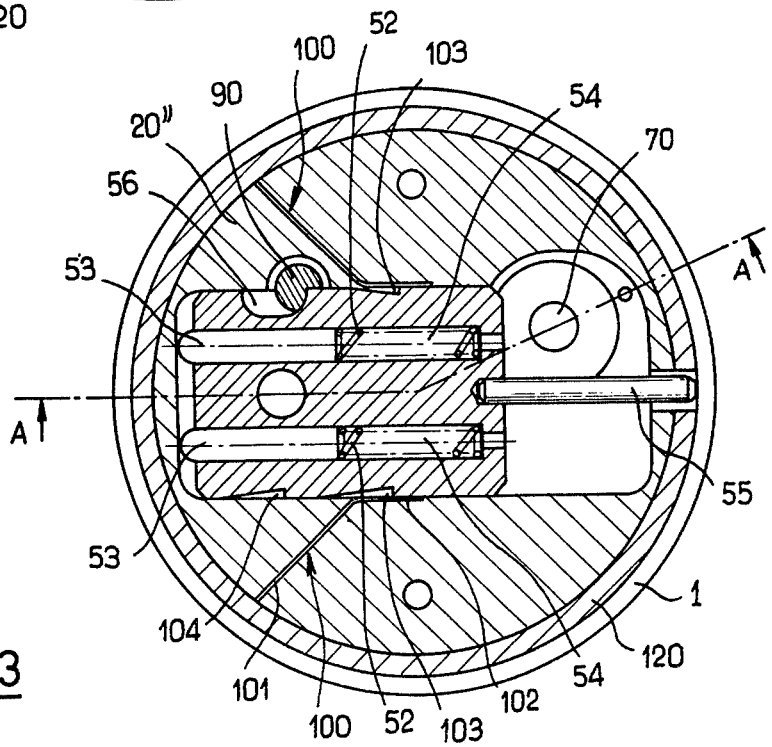
FIG. 3 is a view of the cartridge along the section line denoted by III—III on FIG. 1.

Two light alloy blocks 20' and 20'' containing the exploding unit are immobilised by abutment against each other inside a steel casing 120, by means of screws disposed in two axial bores 60 which are diametrically opposite and provided in each of blocks 20' and 20'', as shown, in particular, in FIGS. 2 and 3. Block 20'' abuts onto a plate 110 which itself abuts on an inner crown 121 of the steel casing 120. The block 20' disposed at the rear of block 20'' in the steel casing 120, is immobilised in the latter by the clamping of a crown 150, provided with a thread on its external periphery, in a corresponding thread made on the inner peripheral area of the rear of steel casing 120. The crown 150 is immobilised relative to the case bottom 4 and forward of the latter by means of standard retaining studs 19, which lodge in bores made respectively in the crown 150 and in an extension of the case bottom 4 which extends axially towards the inside of the case.

It will be appreciated that the steel casing 120 solid with the crown 150 and the assembly of the elements contained in the casing, particularly blocks 20' and 21'' are, accordingly, immobilised initially facing the case bottom 4.

When the combustion gases released through the four nozzles following the ignition of the fragments of propulsive powder 15 exert upon the missile, through a stabiliser cup, as will be described hereinafter, sufficient pressure for shearing the retaining studs 19, the missile will be ejected outside the case 1. The missile, as discussed above is fitted with an explosive assembly the chain beginning of which is formed by a delay firing chain housed in a member 21 of generally cylindrical form mounted by threading in an axial and central orifice of the light alloy block 20''. Blocks 20'' and 20' contain, in addition, as will be set out in the continuation of the description, the various safety devices of the cartridge.

The delay firing chain is composed of a percussive primer 22 accessible from the rear of the missile, an intermediate delaying column 23, and a relay 24.

The light alloy block 20' is provided with a central axial orifice facing the axial orifice of block 20'' and which slidably houses a percussion striker 25. The striker 25 is enclosed in the central axial orifice of block 20'', by means of a plug 35 which lies astride an axial extension 34 which extends the orifice of the block 20', the plug being mounted on the extension 34 by threading. When the missile is initially in position in the case 1, the movement of the percussion striker inside the axial bore of block 20' is limited by means of a fitting ring 30 provided with a collar 31 disposed so as to abut against the case, as will be seen in FIG. 2, and projecting between the percussion striker 25 and the percussive primer 22 of the delay chain.

The body of generally cylindrical shape of this fitting ring is disposed in an off-centre axial bore of block 20'.

Figure 5:
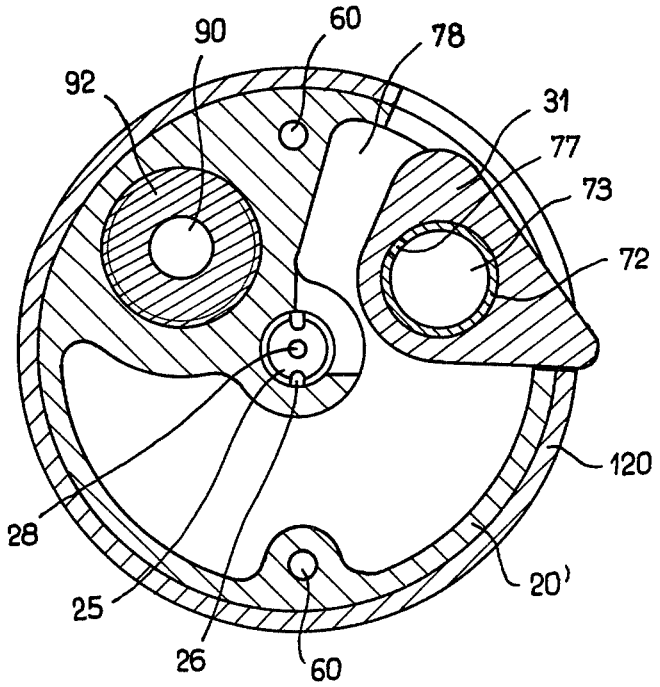
FIG. 5 is a view of the missile having come out of the case, along the section line II—II.

As will be described in greater detail further on in the specification, this fitting ring is pivotably impelled by a spring so as to free the percussion striker by the movement of the collar 31, as is shown in FIG. 5, immediately on the discharge of the missile from the case, until a portion of the collar comes to abut against a part of the body 20' so as to limit the run of collar 31.

The missile having been expelled out of the case 1, and the fitting ring having pivoted from the position shown in FIG. 2 to the position shown in FIG. 5, the striker 25 is free to slide; however, the latter is held against the plug 35 by means of a compression spring 36 housed in the axial central orifice of the light alloy block 20', between the percussive primer 22 and the percussion striker 25. Grooves 26 made along the entire length of striker 25 eliminate the critical air displacement problems caused by the movement of striker 25 in the axial central orifice, an orifice which constitutes a chamber closed by the plug 35. The spring 36 is selected in such a manner as to permit the movement of striker 25 only in the event of a violent shock such as impact. An outermost central stud 28 of the striker then strikes the percussive primer 22 which fires the delay column 23 at the time of the impact.

In order to ensure the proper operation of the striker it is necessary to control accurately the speed and direction of the fall of the missile to obtain an axial deceleration of the latter bringing about the movement by inertia of the striker on impact. This control is obtained with the aid of a stabiliser constituted by a cup 40 comprising a flat circular base solid with an angular extension 42, initially positioned inside crown 150 and three suspending slings 41 connecting the cup 40 to the rear of the light alloy block 20'.

The three suspending slings 41 are provided at each of their ends with loops respectively on hooking pins 43 solid with the light alloy block 20', and on a hooking ring 44. For the purpose, the ends of the suspending slings 41 threaded on the hooking ring 44 pass through three openings distributed at regular intervals over the flat circular base of cup 40, the hooking ring being disposed to abut on the surface of the flat circular base opposite the light alloy block 20'.

The other ends of the suspending slings 41, threaded on the hooking pins 43 enter a respective one of three radial blind holes distributed at regular intervals on the rear of block 20', the three axial orifices being in communication with three radial threaded blind holes made in the block 20', and into which the hooking pins 43 are introduced so as to enter into the outermost loops of the suspending slings 41, the hooking pins 43, threaded externally, being immobilised by screwing in the radial blind holes.

When the missile is housed in the case, the suspending slings 41 are stack-wound between the light alloy block 20' and cup 40. Upon the ejection of the missile, the cup 40 moves away from the missile by the length of the suspending slings and stabilises the latter along the axis of the path. It will therefore be easily understood that such a stabiliser device must be particularly well balanced to ensure a correct orientation of the missile.

The continuity of the exploding chain is initially interrupted by means of a transversely movable detonator-carrying slide 50 housed in a transverse chamber formed in the light alloy block 20″. Detonator 51 is inserted in a bore in the slide 50 with its axis parallel with the axis of the missile. The detonator is staggered relative to the delay firing chain when the missile is situated in the case, in a position which will be referred to as first position in the course of the following description.

Figure 4:
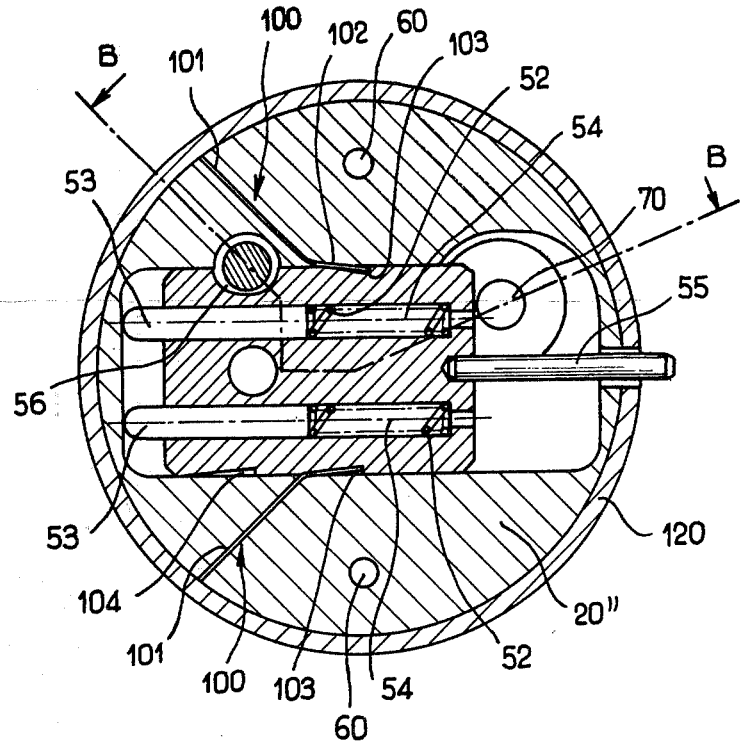
FIG. 4 is a view of a missile along section line III—III, the missile being ejected out of the case.

A safety pin 55, shown in FIGS. 3 and 4, on the one hand, abutting against the inside wall of case 1, and on the other hand, engaged in a lateral bind hole of the detonator-carrying slide 50, prevents any displacement of the latter when the missile is situated inside case 1. When the missile leaves the case, the safety pin 55, however, is pushed radially towards the outside of the missile as will be seen in FIG. 4, permitting the slide 50 to move into lateral abutment against a movable piston 70 as will be explained hereinafter. The position in which the detonator-carrying slide 50 abuts against the piston 70 will be referred to as second position in the ensuing description.

As will be seen in FIG. 3, the slide 50 is acted upon to slide transversely, so as to have the tendency to align detonator 51 and delay firing chain, by two springs 52 acting against two pins 53 which themselves abut against the side wall of the transverse chamber in which the detonator-carrying slide 50 slides, and against the bottom of orifices 54 housing the springs 52. With a view to avoiding problems caused by air displacement when the detonator-carrying slide 50 moves in the closed chamber of the light alloy block 20, the orifices 54 housing the springs 52 are advantageously extended to pass through the detonator-carrying slide through openings of small diameter.

As has already been explained, the detonator-carrying slide 50 abuts initially against the safety pin 55, then, on leaving the case, it abuts laterally against a piston 70 which prevents its sliding. The head 71 of the piston rod is situated in a cylindrical housing 72 filled with a particulate material 73 of calibrated size, such as sand or glass microballs.

This cylindrical housing is advantageously disposed in the off-centre axial bore of the block 20″, housing the body of the fitting ring 30. A part of this cylindrical housing has an outer diameter corresponding to the inner diameter of the body of the ring which is of generally cylindrical shape. Thus, the ring is threaded on this portion of the cylindrical housing so that the latter can act as a swivelling axis, while spring 32, acting upon the ring to make it rotate, is threaded on the remainder of the cylindrical housing, each of its ends being fixed, on the one hand, to collar 31 of the ring and, on the other hand, to the light alloy block 20″.

The movement of the piston is brought about by a spring 74 interposed between one of the outermost walls of the cylindrical housing 72 and the piston head 71. The cylindrical housing 72, has, on its external periphery, an annular projection or spur 75 intended to abut against the bottom of the axial bore in the block 20″ so as to prevent the housing 72 from coming out of the bore. It will be appreciated that this housing is easily introduced into block 20″ with its piston 70 and its piston spring 74, as well as the fitting ring 30 and its spring 32, before block 20′ is placed supported on the block 20″, the microballs 73 being then introduced into the housing through an axial orifice going through block 20′ facing the off-centre axial bore of the housing. When the amount of microballs able to ensure the desired delay time is introduced into the housing, the orifice is obstructed by means of a screw accessible from the back of block 20′.

Figure 7:
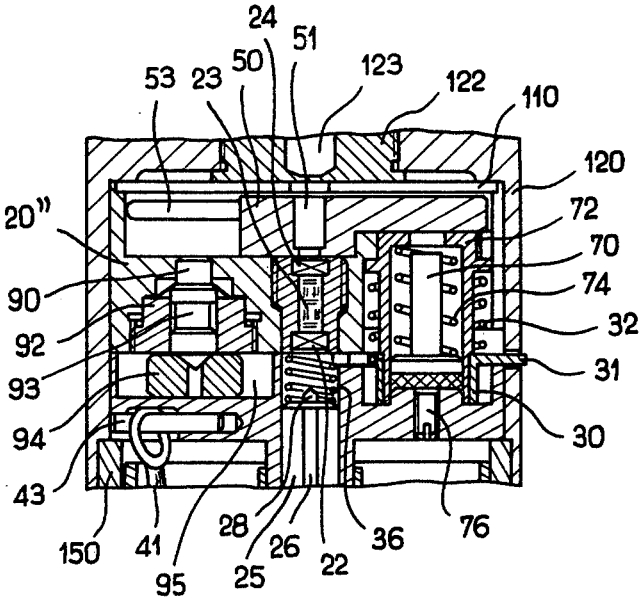
FIG. 7 is a view of the missile along section line I—I, in firing alignment position, the slide being represented along section line A—A.

The cylindrical housing 72 is in communication with a chamber 78 as is represented in FIGS. 2 and 5 through an opening 77 which is normally closed by the body of the fitting ring 30. When the missile is expelled out of the case, the fitting ring 30 is pivotally driven by the action of spring 32, its collar 31 no longer resting on the case. The body of the ring has an orifice which is situated facing the opening 77 when the ring has pivoted and is in the position shown in FIG. 5. It will therefore be easily understood that on the expulsion of the missile, the fitting ring 30 being made to pivot, the opening 77 is freed and the microballs contained in the cylindrical housing 72 begin to run out. The piston head 71 will move downward to follow the reducing level of the microballs to such a level that the detonator-carrying slide 50 is able to slide into a third position, such as shown in FIG. 7, thus ensuring the alignment of the exploding chain at the end of a specific delay time, determined by the flow of the microballs.

In the area of the light alloy block 20″ opposite the cylindrical housing 72, below the transverse chamber receiving the detonator-carrying slide 50 and in contact with it, a recess is provided to receive a cylindrical finger 90 able to slide longitudinally.

One of the ends of the finger abuts against the detonator-carrying slide 50 when the latter is initially abutting against the safety pin 55, and then finally in chain alignment position, which corresponds respectively to said first and third positions. However, the finger is aligned facing an orifice 56 provided laterally in the detonator-carrying slide 50 when the slide is in its second position, abutting against the piston 70. The finger 90 will enter the orifice 56 if the missile knocks against an obstacle, according to a direction having at least one longitudinal component, while the detonator-carrying slide 50 is in its second position.

A resilient washer 91, such as a fan washer, is immobilised in the recess of block 20″ containing the finger 90, with the aid of a threaded plug 92. This recess has section of varying diameters, one of them being intended to form a supporting abutment against which the end of the threaded plug 92 abuts, so as to immobilise the resilient washer, when the threaded plug 92 is mounted in the corresponding threading provided on the internal periphery of the recess.

Figure 6:
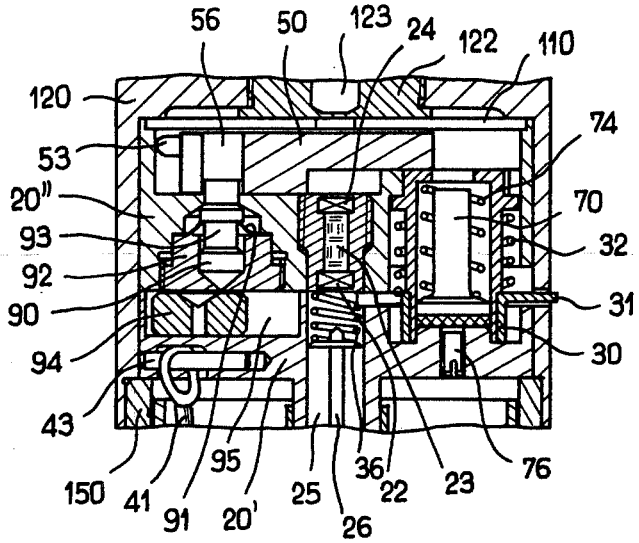
FIG. 6 is a view of the missile along section line I—I, after a close impact safety device has operated, the slide being represented along the section line denoted by B—B in FIG. 4.

Thus, if the missile knocks against an obstacle before the end of the delay time provided by the flow of the microballs 73, that is to say before the detonator-carrying slide has slid into its third position, the finger 90 is projected by inertia towards the front of the missile and is immobilised by means of the claws of the resilient washer 91 engaging in an annular groove 93 of the finger 90. The latter then forms a lateral abutment to prevent the sliding of the detonator-carrying slide 50, as may be seen in FIG. 6.

The finger 90 which constitutes a close impact safety device is completed by an inertia block 94 able to slide in a transverse chamber 95 disposed between blocks 20″ and 20′ and formed by machining the block 20′. The inertia block 94 is provided on one of its faces with a recess in the shape of a truncated cone in which the end of the finger 90 opposite that which is adjacent to the detonator-carrying slide 50 initially positions itself, this end having the general shape of a truncated cone.

The chamber which contains the inertia block 94 permits the movement of the latter along all directions perpendicular to the longitudinal axis of the missile. Consequently, if the missile impacts against an obstacle along a direction having at least one component transverse to the missile axis when the detonator-carrying slide 50 is in its second position, the inertia block moving transversely by inertia, effect the movement of the finger 90 into the orifice 56 of the slide, through the interaction of the interfaces in the shape of truncated cones previously referred to.

This close impact safety device is therefore designed to operate whatever the angle of fall onto the obstacle may be.

Once the detonator-carrying slide 50 has slid into its third position, thus ensuring the alignment of the explosive chain, the close impact safety device is no longer effective because when the missile impacts longitudinally against an obstacle, at the time of impact for example, the finger 90 abuts against the detonator-carrying slide 50 and cannot, consequently, move. Similarly, the inertia block 94 cannot move if the missile knocks against an obstacle transversely, because finger 90, abutting with one of its ends against the detonator-carrying slide 50 and entering partly the inertia block 94 at its other end, prevents any movement of the latter if the detonator-carrying slide is not in its second position.

This arrangement which permits the operation of the close impact safety device only when the slide is in its second position, is particularly advantageous. When the missile is housed in the case, the fitting ring prevents the flow of the microballs, the slide cannot therefore move, and there is no danger that the alignment of the explosive chain can take place; it is therefore necessary to prevent the close impact safety device from operating on the occasion, for example, of an unfortunate fall during handling; indeed, such an operation would have as a consequence the final blocking of the missile when the latter did not present any risk.

Similarly, as soon as the detonator-carrying slide 50 is in its third position, the latter is able to strike the obstacle aimed at, and the close impact safety is no longer required.

Finally, the missile has a non-return device for the slide 50, the device being formed of two elastic blades 100, as shown in FIGS. 3 and 4.

Each of these blades has two sections 101, 102, not aligned.

Section 101 is disposed in a radial bore provided in block 20'', while section 102 extending section 101, is parallel with the lateral sides of the detonator-carrying slide when the latter is in its first position. As soon as slide 50 has slid into its second position the ends of elastic blades 100 abut against first lateral edges 103 of the slide so as to prevent its return to the first position. Similarly, when the slide has slid into its third position, the ends of elastic blades 100 abut against second lateral edges 104 of the slide in such a manner as to prevent any movement of the latter, and to maintain the alignment of the explosive chain with every degree of safety.

A flat plate 110 covering the top part of the light alloy block 20'' ensures the closure of the chamber receiving the detonator-carrying slide 50 and the guiding thereof, this plate being provided with a central opening 111, intended to ensure the continuity of the explosive chain. Plate 110 is immobilised between the light alloy block 20'' and the steel casing 120 containing the explosive assembly and blocks 20'' and 20'. The steel casing 120 of generally cylindrical shape is provided, at the bottom, with an inner crown 121 inside which a member 122 is screwed, this member having at its centre a priming relay 123 which, accordingly, is situated facing the opening 111 of the plate 110, and the detonator 51, when the slide which carries the latter has slid into its third position.

A booster 130 is housed at one end of an explosive pot 131 such as hexolite 131. The booster 130 in contact with the priming relay 123 is initiated by the latter and therefore transmits the explosion to the explosive pot 131, thus breaking and dispersing in small splinters a pre-fragmented sleeve 132 surrounding the explosive pot 131 and a fragmenting disc 133 superimposed upon explosive pot 131, as well as steel casing 120.

A cover 120 is mounted by threads at the end of steel casing 120, the cover 140 being advantageously provided with standard blind holes 141 permitting the use of a suitable tool to obtain the proper clamping torque.

The seal-tightness of the assembly is obtained in perfect manner by means of two O-rings, one, 142, situated between the outermost face of an extension of the cover 140 and the pre-fragmented sleeve 132, the other, 143, housed in a peripheral annular groove of the cover 140 and therefore situated between the latter and case 1.

It will be understood from the foregoing description that, by applying a continuous voltage between case 1 and the contact 17, the primer 16 is fired; the latter then effects the ignition of the propelling powder fragments 15, which brings about the release of the combustion gases through the four nozzles and permits the application of an increasing pressure against the cup 40 of the stabiliser.

When this pressure is adequate, the retaining studs 19 are sheared and the missile is expelled out of case 1. The cup then moves away from the missile by the length of the suspending slings and stabilises the missile on the axis of the path.

On the ejection of the missile out of the case, the safety pin 55 is pushed back under the action of springs 52 and the slide moves into its second position, such as shown in FIG. 4, to abut against the piston 70.

The resilient blades 100 abutting against the lateral edges 103 of slide 50 prevent the return of the slide into its first position.

Also, on the ejection of the missile out of the case, the fitting ring 30 pivots into the position shown in FIG. 5. This pivoting permits the movement of the striker 25 which is, however, kept away from primer 22, by means of spring 36.

The pivoting of the fitting ring 30 frees the orifice 77 through which the microballs can flow. Piston 70 impelled by spring 74 moves, following the level of the microballs, and at the end of its stroke frees the slide 50, the latter being acted upon by springs 52 and moving, in turn, to bring the detonator 51 into chain alignment.

The resilient blades 100 abutting against the side edges 104 of slide 50 then prevent any return of the latter.

When the missile strikes against the ground, spring 36 is compressed, and striker 25 strikes primer 22 which ignites the delay column 23. The missile rebounds and goes up again.

When the delay column 23 has ended its combustion, it initiates through the relay 24 the detonator 51, the detonation being then transmitted to the booster 130 and to the explosive pot 131 through the priming relay 123, the pre-fragmented steel sleeve 132, the casing 120 and all the other mechanical part are broken and dispersed.

The explosion therefore occurs at a constant altitude, independent of the release height.

The cartridge may, in addition, be handled and stored quite safely. Indeed, during storage, the piston is in disaligned position, and a break of the exploding chain is thus obtained, this being determined by the thickness of the internal crown 121 between detonator 51 and priming relay 123, and by the thickness of the slide 50 between the detonator 51 and relay 24. This interruption of the chain is maintained until the movement of the piston 70, i.e. for about 0.4 seconds after ejection.

Moreover, as was stated previously, the finger 90 constituting the so-called close impact safety device blocks the slide in broken chain arrangement if the missile strikes an obstacle between the time when the missile comes out of the case and the end of the flow of the microballs.

Generally speaking, the present invention is not limited to the examples of embodiment described and represented hereinabove, from which it will be possible to provide for other forms and other methods of embodiment, within the scope of the appended claims.

I claim:

1. A cartridge for a missile programmed for detonation at an altitude above the ground comprising:

a cartridge case having a bottom section rigidly connected thereto;

an ejectible missile within said case;

means in said case bottom section for impelling the missile from said case;

said missile comprising a detonable payload, an impact-operable slidable striker means having a predetermined axis of displacement, and a delay firing chain comprising a pyrotechnic delay column disposed between said payload and said striker means and in alignment with said striker means;

means for stabilizing the trajectory of the missile on an axis corresponding to the axis of the striker means axis of displacement;

means in said missile for rebounding said missile upon ground impact toward an altitude above the ground; and means for simultaneous sliding said striker means on said ground impact to strike said delay firing chain initiating combustion of said pyrotechnic delay column and subsequent ignition and detonation of said payload at said altitude after the combustion of said delay column.

2. A cartridge according to claim 1, wherein the stabilising means comprises a plurality of suspending slings, and a cup at the rear of the missile, said slings being connected to the cup to ensure axial deceleration of the missile.

3. A cartridge according to claim 1, further comprising spring means interposed between said striker means and said delay firing chain to keep the striker means away from the delay firing chain before impact, and means limiting sliding movement of the striker means before the missile is discharged from the case, said limiting means being moved upon discharge of the missile from the case to free the striker means.

4. A cartridge according to claim 3, wherein said limiting means comprises a ring provided with a collar, disposed so as to abut against the case and projecting between the striker means and the delay firing chain before the missile comes out of the case, and spring means acting on the ring to pivot the ring after discharge from the case so as to free the striker means.

5. A cartridge according to claim 4, further comprising a detonator, a slide carrying the detonator, safety pin means for the slide, and a delay device providing a delay time, said slide being immobilised in a first position before the missile leaves the case, by the safety pin means abutting against the case and against the slide, said slide being movable into a second position abutting against said delay device, after the missile leaves the case, for a period determined by the delay device, the detonator-carrying slide ensuring the disalignment of the detonator relative to the delay firing chain and to the payload in the first and second position, and said slide moving into a third position after the delay time, said slide when in the third position providing alignment of the detonator with the firing chain.

6. A cartridge according to claim 5, wherein the delay device comprises a piston acting as an abutment for said slide when the slide is in said second position, spring means acting on said piston, means defining a chamber for the piston, particulate material contained within the chamber and opposing movement of the piston under the action of the spring means, means defining an opening from the chamber for the particulate material, said opening being obstructed by said ring prior to discharge of the missile from the case, pivoting of said ring after the missile has left the case freeing said opening and permitting said material to flow from the chamber whereby said piston is moved by said spring means to free the slide after a delay determined by the flow of material from the chamber.

7. A cartridge according to claim 6, further comprising a close impact device comprising a finger able to slide longitudinally and abutting against the slide when the latter is in the first and third positions, and means defining an orifice in the slide, said orifice being aligned with the finger when the slide is in its second position, said finger being projected by inertia forces into the orifice if the missile strikes an obstacle, along a direction having at least one longitudinal component, between the time when the missile leaves the case and the end of the delay time defined by the flow of the particulate material.

8. A cartridge according to claim 7, wherein the close impact device further comprises an inertia block which slides transversely of the finger and which includes a conical interface co-operating with the finger, said block being moved if the missile strikes an obstacle along a direction having at least a transverse component relative to the missile, when the slide is in second position, so as to project the finger into the orifice of the slide and immobilise it.

9. A cartridge according to claim 7 or claim 8, wherein the close impact system further comprises an elastic washer provided with claws, and means defining an annular groove in the finger, said claws engaging in the annular groove of the finger when the latter has entered the orifice of the slide, so as to immobilise the finger in a position to prevent the sliding of the detonator-carrying slide.

10. A cartridge according to claim 5, further comprising a non-return device comprising at least one resilient blade having an end operative to abut against the slide when the latter is in its second and third positions, so as to prevent its return to a previously occupied position.

11. The invention set forth in claim 1 wherein said impelling means comprises means for generating an impelling gas and nozzle means for directing said gas against said missile.

12. The invention set forth in claim 1 in which said delay column includes a percussion primer, an intermediate delay column and a relay for detonating said payload.

13. The invention set forth in claim 1 further including means for preventing sliding movement of said striker means prior to the missile exiting said case.

14. The invention set forth in claim 1 further including means for preventing actuation of said striker means when said missile strikes a surface having a component transverse to the direction of said missile.

15. The invention set forth in claim 1 wherein said means for rebounding and said sliding movement of said striker means comprises a spring means compressible upon ground impact.

16. A cartridge comprising:

a case including a case bottom rigid with the case, and nozzle means housed in the case bottom and acting as an impeller for ejecting a missile outside the case;

a missile disposed in front of the impeller, said missile including a pyrotechnic payload, a sliding striker means having a predetermined axis of displacement, a delay firing chain comprising a pyrotechnic delay column disposed between said payload and said sliding striker means and and in alignment with said sliding striker striker means, and stabiliser means for stabilising the trajectory of the missile on an axis corresponding to the axis of displacement of said sliding striker means, and means for sliding said striker means upon ground impact of said missile to initiate firing of said delay firing chain; and whereby, on impact, the missile rebounds and said sliding striker means strikes the delay firing chain which in turn, when the delay column has ended its combustion, ignites the payload above the ground.

* * * * *